United States Patent [19]

Foster, Jr. et al.

[11] Patent Number: 5,020,517

[45] Date of Patent: Jun. 4, 1991

[54] BACK MASSAGER FOR USE IN HOME OR AUTO

[75] Inventors: Robert W. Foster, Jr., Hinsdale; Jefferson L. Gentry, Deerfield, both of Ill.

[73] Assignee: Associated Mills Inc., Chicago, Ill.

[21] Appl. No.: 434,790

[22] Filed: Nov. 13, 1989

[51] Int. Cl.[5] ..... A61H 1/00

[52] U.S. Cl. ..... 128/33; 128/36; 128/399; 297/DIG. 3; 297/230; 297/284

[58] Field of Search ..... 128/33, 34, 36, 52, 128/58, 399; 5/432, 447; 297/DIG. 3, 230, 284

[56] References Cited

U.S. PATENT DOCUMENTS

| | | | |
|---|---|---|---|
| 3,811,430 | 5/1974 | Kawakami | 128/33 |
| 4,175,297 | 11/1979 | Robbins et al. | 128/33 X |
| 4,190,286 | 2/1980 | Bentley | 5/432 X |
| 4,203,098 | 5/1980 | Muncharyan | 128/33 X |
| 4,335,725 | 6/1982 | Geldmacher | 5/432 X |
| 4,516,568 | 5/1985 | Baxter et al. | 5/432 X |
| 4,732,140 | 3/1988 | Stoffregen | 128/36 |

*Primary Examiner*—Edgar S. Burr
*Assistant Examiner*—Moshe I. Cohen
*Attorney, Agent, or Firm*—Laff Whitesel, Conte & Saret

[57] ABSTRACT

A back massager is powered through a control unit attached to a back cushion via a cable. The control unit has a jack coupled to a control circuit and through the cable to the cushion. Either an AC adapter or a 12 DC battery adapter may be plugged into the jack. Therefore, the same massager may be used in the home or an automobile (or the equivalent thereof). An air bladder may be pumped up or exhausted to control the firmness of the cushion.

7 Claims, 3 Drawing Sheets

BACK MASSAGER FOR USE IN HOME OR AUTO

This invention relates to back massagers and more particularly to massagers which may be used in both home and auto.

Back massagers are known devices which provide a vibrating cushion that may be placed against the back of a chair or other seating device. Then, a person sits in the chair and leans back against the vibrating cushion. There are back massagers which plug into a wall outlet and which are thus energized by commercial electrical power. There are also back massagers which plug into an automobile electrical system and thus are energized from the auto battery. As a result, a user has had to purchase two massagers if he wishes to use a back massager in both the home and an automobile. The store owner has to stock two models of back massagers, thus requiring twice as much counter and storage space as would be required if a single massager could be used in two places.

Accordingly, an object of this invention is to provide new and improved back massagers for use in many locations. Here, an object is to provide a massager which may be powered by either commercial power or an automobile battery (or the equivalent thereof).

Another object is to provide such a back massager which may be inflated or deflated by varying amounts in order to provide varying degrees of firmness in the lumbar region of the back.

In keeping with an aspect of the invention, these and other objects of the invention are accomplished by providing a back massager with a control unit in a housing having a jack therein. The user has two adapters, each with an extension cord which has a plug for completing a circuit through the jack. One of the adapters plugs into an AC wall outlet to supply commercial power, while the other adapter plugs into a cigarette lighter of an automobile to supply battery power. Preferably, the control box contains a rectifier so that the AC will be rectified to drive a DC motor. The polarity of the rectifier and the DC voltage level is such that the DC battery of an automobile also energizes the DC motor. Heat may also be supplied in the back massager, if desired.

Preferred embodiments of the invention are shown in the attached drawings, in which.

Figure 1:
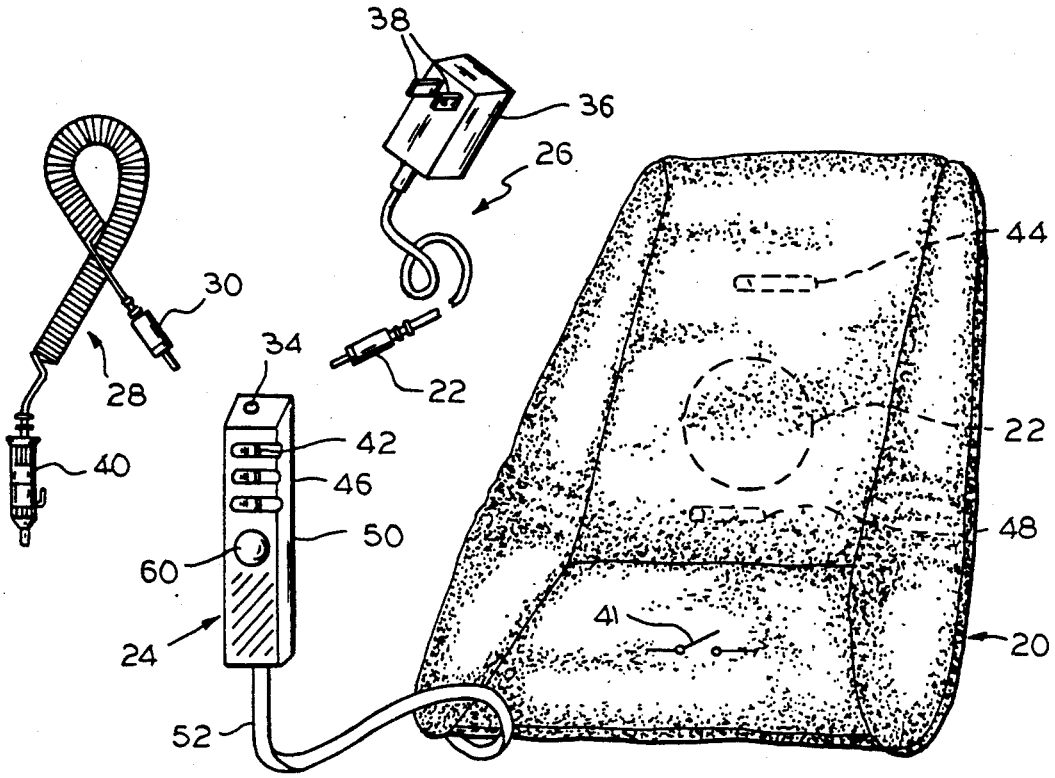
FIG. 1 is a perspective view of the inventive back massager, its control unit, and its two adapters.

FIG. 1 includes a back massager cushion 20 having an air inflatable bladder 22 therein, a control unit 24, an AC adapter 26, and an automobile adapter 28.

Both of the adapters 26, 28 have an extension cord with the same types of plugs 30, 32 which fit into a jack in the end of the control unit housing. The opposite end of the extension wire of adapter 26 includes a transformer 36 with terminals 38 that plug into a standard AC wall outlet. The opposite end of the extension wire of adapter 28 includes a plug 40 which fits into a cigarette lighter socket in an automobile. A seat switch 41 shuts off the vibrator if the person using it leaves his position.

The control unit 24 includes a number of manually operated control switches, of which switch 42 controls an upper thoracic vibrator 44. The switch 46 controls a lower lumbar vibrator 48. Switch 50 controls a heater which is built into the cushion. Each of these switches may have off, high level and low level positions. Each of the vibrators 44, 48 may be a small motor driving an off-center weight.

The control unit 24 is connected to cushion massager 20 via a cable 52 which contains wires 54 and a hose 56. The wires complete connections from the switches 42, 46, 50 to corresponding parts in the control unit and cushion.

Figure 2:
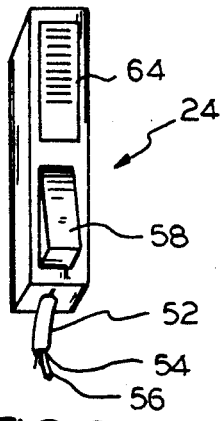
FIG. 2 is a perspective view of a hand pump on the back of the control unit.

The hose 56 extends from an air pump 58 (FIG. 2) and exhaust valve 60 to the bladder 22, which are used to control the amount of air in the bladder 22 and, therefore, the firmness of the massager. The air pump 58 is a simple piece of molded rubber which is squeezed to drive air through hose 56 and in to the bladder 22 in the cushion. The exhaust valve 60 opens the hose 56 to the atmosphere while the weight of a person leaning on the cushion forces air out of the bladder 22, through hose 56, and into the atmosphere. The control unit housing includes a series of vents 64 which provide both the intake and the exhaust opening into the atmosphere.

Figure 3:
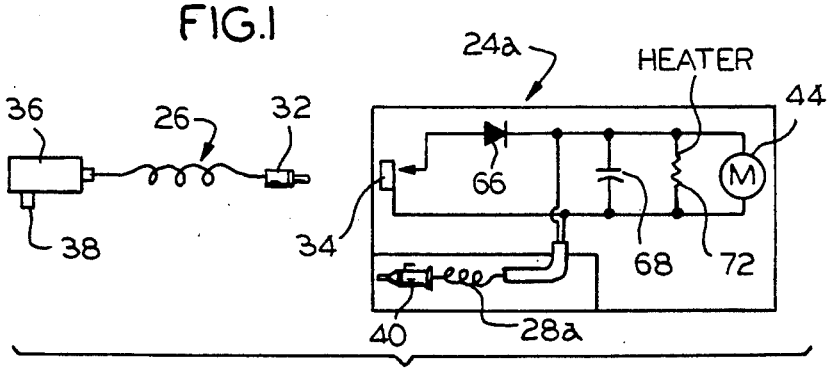
FIG. 3 shows an alternative control unit having a built in compartment for storing an adapter for use in an automobile.

FIG. 3 illustrates an alternative arrangement for the control unit housing 24*a*. Here, the automobile adapter 28*a* is built into a compartment in the control unit so that it is not necessary to carry a number of loose parts into an automobile and to keep track of them, once there. This is especially important to people who may wish to place the massager in a trunk or other place which may not be too clean so that the end plug 40 (Fig.) could pick up grease, grime or the like which should not be placed in a socket in the automobile. If the massager is not built with the air bladder 22, the auto adapter 28*a* is placed in a compartment which would otherwise include the air pump 58.

Figure 4:
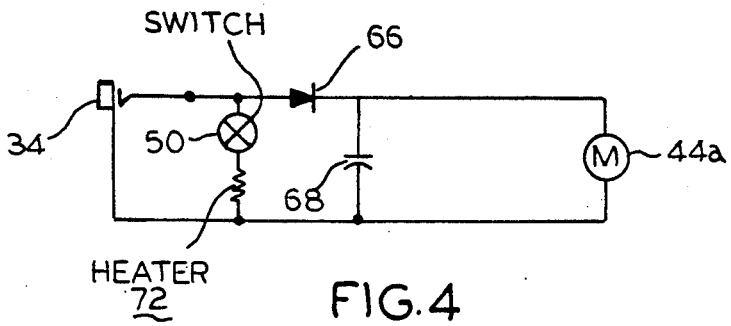
FIG. 4 is a very simple circuit for energizing the massager motor, which is useful for explaining the invention.

In the control unit 24*a* of FIG. 3, a half wave rectifier 66 converts the AC received at jack 34 into DC. A capacitor 68 provides a filter which smooths the DC to drive the vibrator 44*a*. The DC connection to the auto battery, via wire 28*a*, is completed between the rectifier 66 and the smoothing filter. Therefore, the rectifier 66 does not enter into the operation when DC power is supplied from an automobile battery. In FIG. 3, the heater 72 is after the rectifier, which places a load on it. In FIG. 4, the heater 72 is coupled into the circuit before the rectifier 66 in order to reduce the load upon it.

Figure 5:
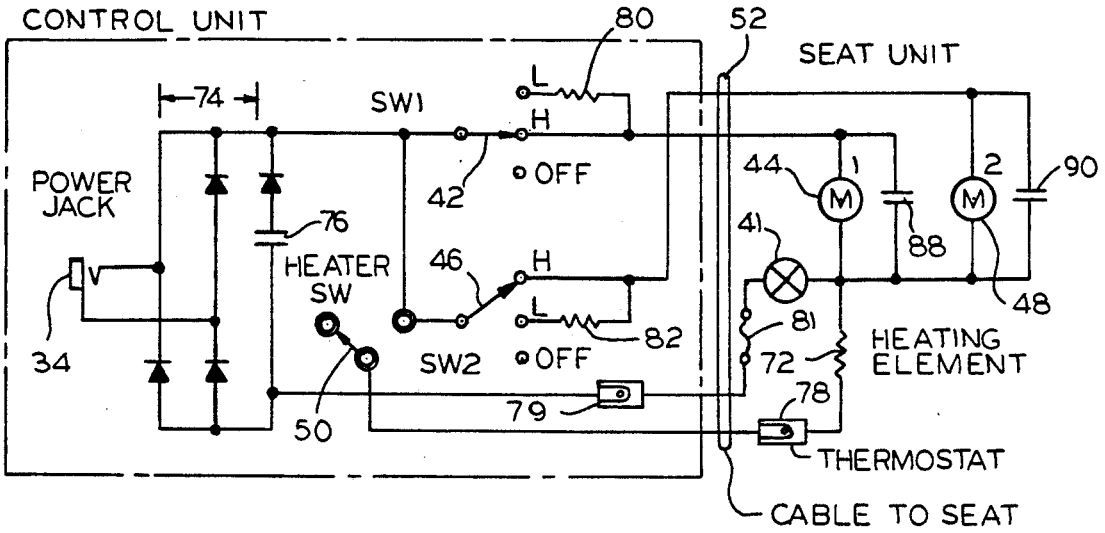
FIGS. 5–8 are four alternative electric circuits for use in connection with the inventive back massager.

FIG. 5 shows a control circuit including the concepts which are set forth above. The power jack 34 may be used to make connections to either of the adapters 24, 26 (FIG. 1). A full wave rectifier 74 is coupled to the jack 34. A smoothing capacitor 76 is coupled across the rectifier to smooth the rectified AC in order to produce a usable DC voltage. The switch 50 selectively energizes or deenergizes the heating element 72, which is controlled by a thermostat 78. Another thermostat 79 in the control unit shuts off the system if there is an unacceptable amount of heat, as from the rectifier bridge 74, for example. Preferably, a one shot fuse 81 is in the cushion 20. This fuse should not flow unless the wires are frayed or some damage has been done, for example, some one drives over the cushion. Therefore, preferably, the fuse 81 cannot be replaced and the cushion must be thrown away after fuse 81 burns out, to protect the user.

Capacitors 88, 90 are coupled across the vibrator motors 44, 48 to prevent radio frequency interference responsive to the operation of the circuit.

Each of the switches 42, 46 has an off, a high (direct connection) and a low (through resistor 80 or 82) position. In the positions shown in FIG. 5, each of the switches is in a "high" position which means that vibration will occur at a high energy level. Switch 42 controls the upper back vibrator 44, while switch 46 controls the lower back vibrator 48 (as indicated in the drawing by the numbers "1" and "2" adjacent "SW" and "M", respectively). In cushion 20, a seat switch 41 opens all circuits if the person using the massager leaves his position. This way, a person does not have to remember to turn off the back massager when he goes away.

Figure 6:
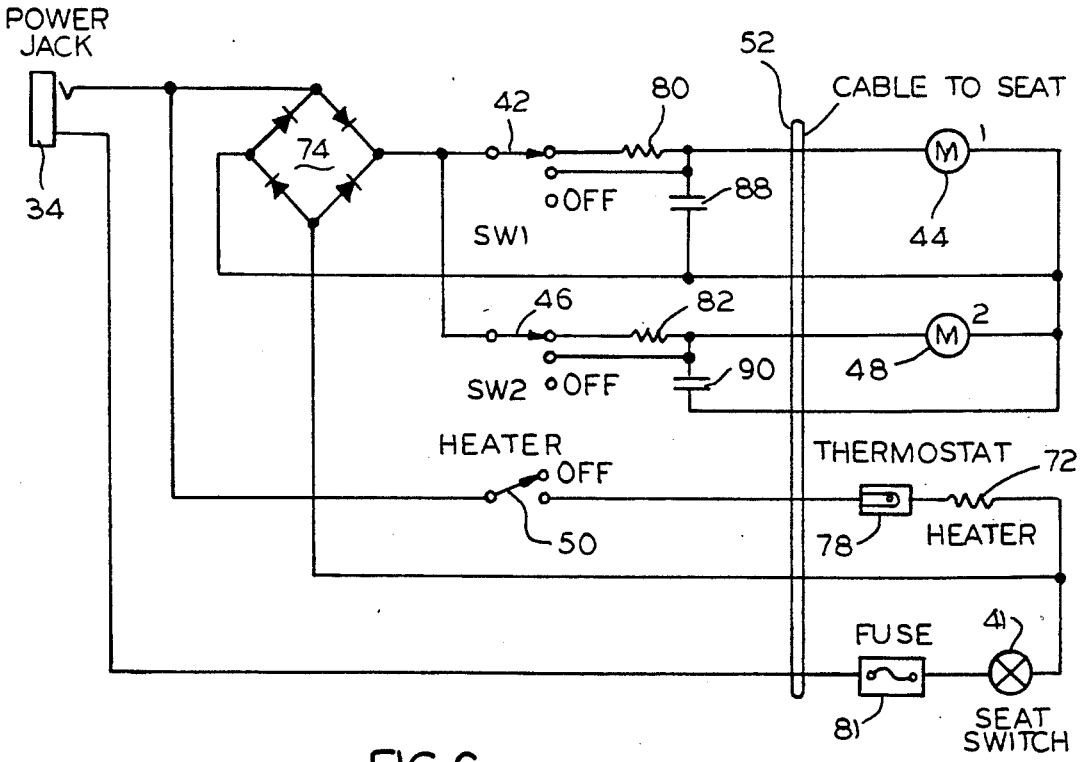

In FIG. 6, the heater 72 and its thermostat 78 are connected between the full wave rectifier 74 and the jack 34 in order to reduce the demands upon the rectifier. Again, fuse 81 is provided to burn out and protect the user if there should be a short circuit so that the massager should be discarded. Otherwise FIG. 6 is the same as FIG. 5.

Figure 7:
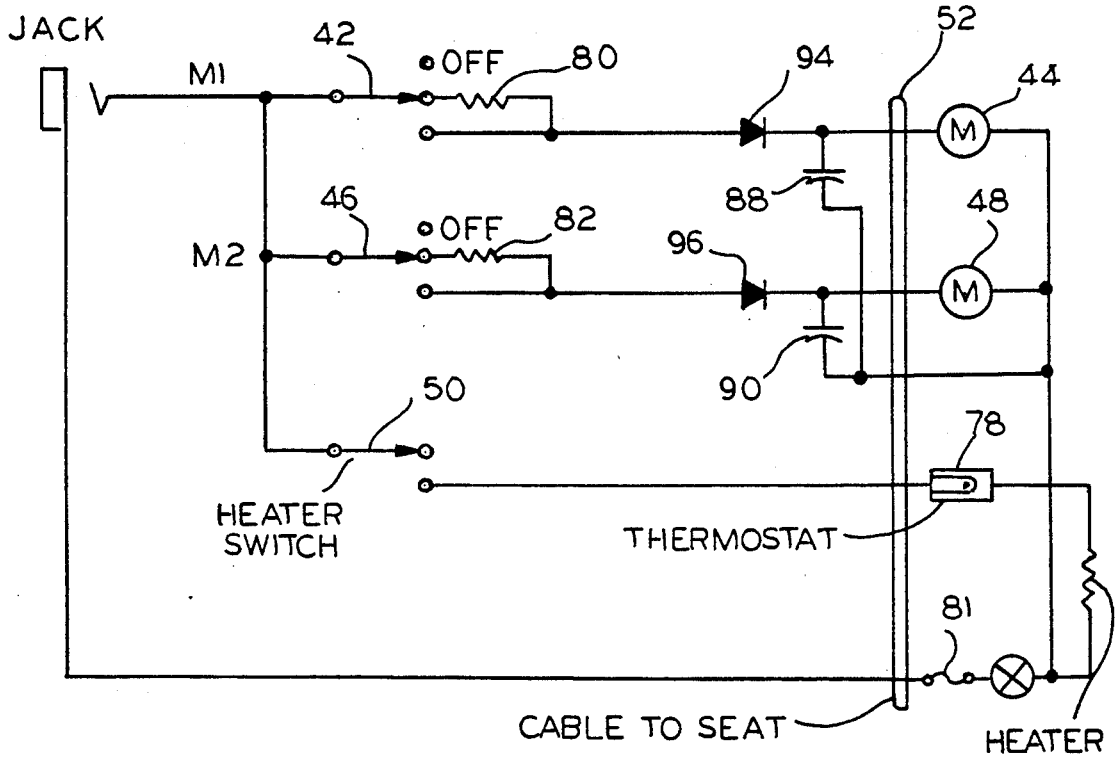
Figure 8:
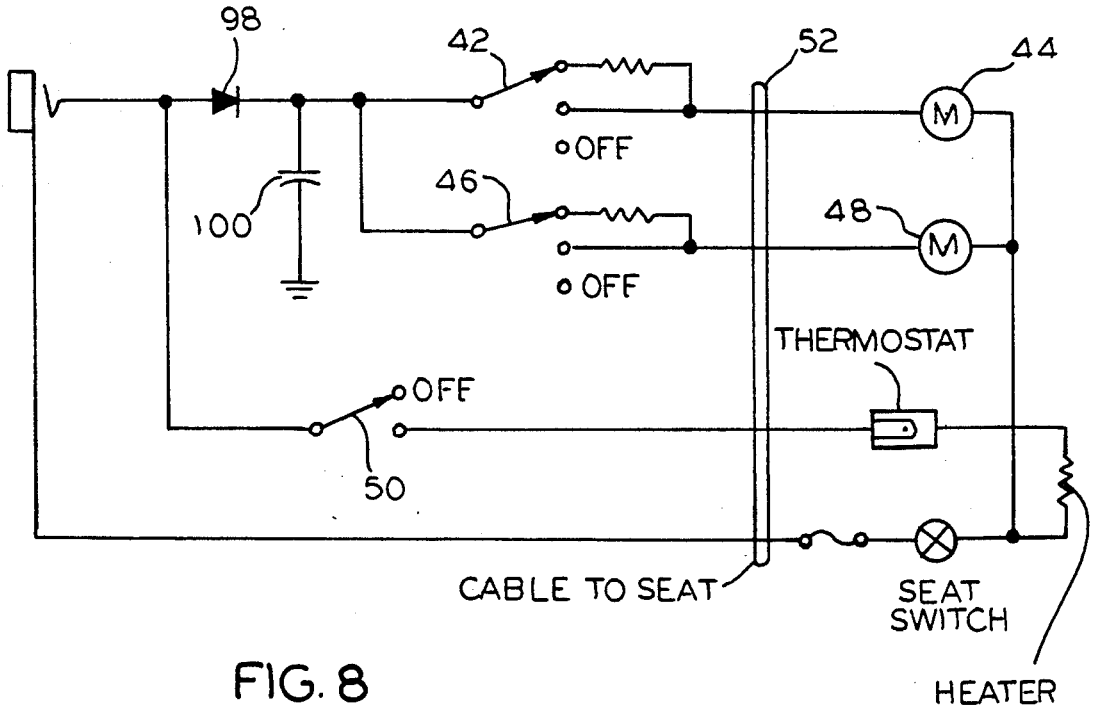

In FIG. 7, the full wave rectifier is replaced by two diodes which are a half wave rectifier 94, 96. The diodes 94, 96 are individually associated with the vibrators 44, 48, because two smaller, lower cost diodes may be used. However, it also be understood that a single diode 98 (FIG. 8) may also be used for supplying half wave rectification to both vibrators 44, 48, when it costs less then the two smaller diodes 94, 96. In addition, one must also consider the cost of a single large capacitor 100 to eliminate RF noise, as compare to the costs of the two smaller capacitors 88, 90 of FIG. 7. Also, one needs to consider the differences in current drain resulting from the various circuits. Hence, FIGS. 7-8 represent different approaches which may be used interchangeably as the costs of parts may change, from time to time. Otherwise FIGS. 7, 8 are the same as the circuits of FIGS. 5,6.

An advantage of the inventive design is that a single back massager may be used at home or in any other location where 12-volts DC may be available, such as in an auto, boat,.or the like. The various designs enables a manufacturer to make a product at the lowest cost and to change its design as costs change.

Those who are skilled in the art will readily perceive how to modify the invention. Therefore, the appended claims are to be construed to cover all equivalent structures which fall within the true scope and spirit of the invention.

We claim:

1. A massager comprising a cushion having two vibrator motors therein, one of said vibrator motors being positioned in the upper thoracic region of said cushion, the other of said vibrator motors being in the lower lumbar region of said cushion, a control unit attached to said cushion via a cable for controlling at least an application of power thereto for switching said vibrator on or off, a jack associated with said control unit, at least two adaptor means for selectively applying power through said jack and said control unit to said vibrator motors, one of said adapter means being arranged to be connected to an AC commercial power source, and the other of said adapter means being arranged to be connected to a battery means in said control unit for selectively and individually energizing said vibrator motors at either a "high" or a "low" energy level, an air bladder in said cushion in a region which confronts the lumbar region of a person resting against said cushion, and means for selectively adjusting the degree of inflation of said bladder in order to adjust the firmness of said massager.

2. The massager of claim 1 wherein said means for selectively adjusting the degree of inflation comprises a hand pump and an exhaust valve in said control unit and coupled to said bladder via a hose in said cable.

3. The massager of claim 2 wherein said means for energizing said vibrator motors comprises a rectifier in said control unit, and heater means in said cushion coupled to said jack at a point before said rectifier whereby said rectifier does not have to carry current for said heater.

4. The massager of claim 2 and seat switch means in said cushion for removing all power from said control unit when said massager cushion is not occupied.

5. The massager of claim 4 and a single shot fuse means in said cushion for permanently removing all power from said cushion in there is a danger to the person who is occupying said cushion.

6. The massager of claim 1 and seat switch means in said cushion for removing all power from said control unit when said massager cushion is not occupied.

7. The massager of claim 1 and a single shot fuse means in said cushion for permanently removing all power from said cushion if there is a danger to the person who is occupying said cushion.

* * * * *

UNITED STATES PATENT AND TRADEMARK OFFICE

CERTIFICATE OF CORRECTION

PATENT NO. : 5,020,517

DATED : June 4, 1991

INVENTOR(S) : Foster et al

It is certified that error appears in the above—identified patent and that said Letters Patent is hereby corrected as shown below:

In col. 4, line 11, insert --motors-- between "vibrator" and "on".

In col. 4, line 18, insert a comma --,-- between "battery" and "means".

Signed and Sealed this

Sixth Day of October, 1992

*Attest:*

DOUGLAS B. COMER

*Attesting Officer*

*Acting Commissioner of Patents and Trademarks*